US010793973B2

(12) United States Patent
Auguste et al.

(10) Patent No.: US 10,793,973 B2
(45) Date of Patent: Oct. 6, 2020

(54) SYNTHETIC FIBRE AND AN ARTIFICIAL LAWN COMPRISING SUCH A FIBRE

(75) Inventors: Jean-Claude Auguste, Dayton, TN (US); Harry R. Ma, Hixson, TN (US)

(73) Assignee: Ten Cate Thiolon B.V., Nijverdal (NL)

( * ) Notice: Subject to any disclaimer, the term of this patent is extended or adjusted under 35 U.S.C. 154(b) by 904 days.

(21) Appl. No.: 13/174,997

(22) Filed: Jul. 1, 2011

(65) Prior Publication Data

US 2013/0004683 A1 Jan. 3, 2013

(51) Int. Cl.
*E01C 13/08* (2006.01)
*D01D 5/253* (2006.01)

(52) U.S. Cl.
CPC ..... *D01D 5/253* (2013.01); *E01C 13/08* (2013.01); *Y10T 428/23957* (2015.04); *Y10T 428/2973* (2015.01); *Y10T 428/2978* (2015.01)

(58) Field of Classification Search
CPC ..... E01C 13/08; D01D 5/253; D02G 3/445; D01B 2505/02; Y10S 273/13
USPC ..... 428/17, 397, 400, 92, 97
See application file for complete search history.

(56) References Cited

U.S. PATENT DOCUMENTS 4,416,934 A * 11/1983 Kimura et al. ..... 442/195
4,472,477 A * 9/1984 Phillips ..... 442/193
4,590,032 A * 5/1986 Phillips ..... D01D 5/253 264/103
5,268,229 A * 12/1993 Phillips et al. ..... 428/400
5,387,469 A * 2/1995 Warren ..... 428/397
5,447,771 A * 9/1995 Mills ..... D01D 5/253 428/397
6,426,140 B1 * 7/2002 Phillips et al. ..... 428/375
6,753,082 B1 * 6/2004 Lobovsky et al. ..... 428/397
6,884,505 B2 * 4/2005 Shoemaker ..... D01D 5/253 428/364

(Continued)

FOREIGN PATENT DOCUMENTS

CN 201459568 U * 5/2010
EP 1 158 099 A2 11/2001

(Continued)

OTHER PUBLICATIONS

Machine translation of JP 09-111532A (Apr. 28, 1997).*

*Primary Examiner* — Cheryl Juska
(74) *Attorney, Agent, or Firm* — N.V. Nederlandsch Octrooibureau; Catherine A. Shultz; Katelyn J. Bernier

(57) ABSTRACT

The present invention relates to synthetic fibers and artificial lawn comprising such a fibre. More particularly, the invention relates to grass-like monofilament type fibers having a curved cross section and an artificial grass lawn, especially an artificial grass sports field, comprising such a fibre.
According to an aspect of the invention, a synthetic fibre is provided of the monofilament type for use in an artificial lawn, in particular an artificial sports lawn, which synthetic fibre has a curved cross section, wherein the synthetic fibre has a centre line arc length to maximum thickness of less than 8, preferably between 4.5 and 3.8, and even more preferably between 4.4 and 4.0.
In an other aspect of the invention, a synthetic fibre is provided of the monofilament type for use in an artificial lawn, in particular an artificial sports lawn, which synthetic fibre has a curved cross section, wherein the circumferential surface of the fibre is provided with a wave shaped pattern.

6 Claims, 6 Drawing Sheets

(56) References Cited

U.S. PATENT DOCUMENTS

| | | | | |
|---|---|---|---|---|
| 7,018,946 | B2 * | 3/2006 | Shoemaker | D01D 5/253 428/357 |
| 7,939,144 | B2 * | 5/2011 | Verleyen | 428/17 |
| 2001/0033902 | A1 | 10/2001 | Seaton | |
| 2003/0216095 | A1 * | 11/2003 | Basalik | 442/118 |
| 2006/0159917 | A1 * | 7/2006 | Verleyen | 428/364 |
| 2009/0098378 | A1 * | 4/2009 | Spaans et al. | 428/397 |
| 2011/0262665 | A1 * | 10/2011 | Olde Weghuis et al. | 428/23 |
| 2012/0114942 | A1 * | 5/2012 | Emge et al. | 428/400 |
| 2012/0156401 | A1 * | 6/2012 | Spaans et al. | 428/17 |
| 2012/0189785 | A1 * | 7/2012 | Rossing et al. | 428/17 |
| 2012/0270045 | A1 * | 10/2012 | Testa | 428/397 |
| 2012/0279125 | A1 * | 11/2012 | Nusca et al. | 47/66.7 |

FOREIGN PATENT DOCUMENTS

| | | | |
|---|---|---|---|
| EP | 1255894 | B1 | 5/2006 |
| EP | 2284318 | A1 * | 2/2011 |
| KR | 1019890002109 | B1 * | 6/1989 |
| WO | 0161110 | A1 | 8/2001 |
| WO | 2005/005730 | A1 | 1/2005 |
| WO | 2010/082816 | A1 | 7/2010 |
| WO | WO 2011006878 | A1 * | 1/2011 |
| WO | 2011/027235 | A1 | 3/2011 |
| WO | WO 2013006042 | A1 * | 1/2013 |

* cited by examiner

SYNTHETIC FIBRE AND AN ARTIFICIAL LAWN COMPRISING SUCH A FIBRE

FIELD OF THE INVENTION

The present invention relates to synthetic fibers and artificial lawn comprising such a fibre. More particularly, the invention relates to grass-like monofilament type fibers having a curved cross section and an artificial grass lawn, especially an artificial grass sports field, comprising such a fibre.

DESCRIPTION OF THE PRIOR ART

Natural grass is often used intensively and as a result thereof and as a result of others such as varying weather influences, sustain a great deal of damage. A number of artificial lawns have been introduced to provide an alternative for natural grass. These artificial lawns are used both indoors as well as outdoors. A well known example of such an outdoor artificial lawn is an artificial grass sport field, for example, for playing soccer, field hockey, tennis, American football and the like. For example in WO 2010/082816 A1 in the name of the same applicant such an artificial lawn is disclosed.

Artificial lawns, like artificial grass sport fields, require less maintenance and can be used/played-on much more intensively than lawns of natural grass. Artificial lawns, however, must have specific properties in order to be able to withstand the loads to which they are subjected as a result of intensive use. Furthermore they must exhibit a natural look.

A drawback of synthetic fibres used for artificial lawns is that they tend to assume a flat orientation relative to the ground surface during use. This can result in so-called "bare patches" in the lawn and can thus increase the risk of injuries, decrease the playing characteristics and/or give a less natural look, etc.

In order to, at least partially, overcome this drawback, a thick layer of infill can be provided on the artificial lawn. Such a thick layer of infill is for example disclosed in EP 1158099 A2. Installing this thick layer of infill is, however, more labor intensive than installation of a natural lawn. Furthermore substantially more maintenance is required as the infill, over time, gets a less uniform distribution due to non-uniform use of the lawn.

An alternative for the thick layer of infill is to provide an artificial lawn having synthetic fibres which have an increased stiffness and resilience. This result can be achieved by changing the chemical composition and/or the processing method. This, however, is undesirable because it will lead to a more complex production process and/or abrasive artificial lawn with an increased risk of injuries.

Another solution for the problem as described above is to adapt the geometry of the synthetic fibre, for example as disclosed in WO 2010/082816 A1. The fibre disclosed herein has such a geometry that it has an increased resistance to the loads applied thereon when playing a sport on the field. The surface of the fibre however is smooth and in combination with used chemical compositions result in a shiny, non natural, synthetic look. In WO 2005/005730 A1 a fibre is disclosed comprising stiffness-enhancing agents. These agents, i.e. protrusion ribs, increase the fibre's stiffness/resilience and because of the non-smooth surface exhibits a light scattering effect, decreasing the synthetic fibre's shiny look.

Due to the presence of thickened or narrowed parts, i.e. so called "spines" or "buckles", in the fibres discloses in both documents WO 2010/082816 A1 and WO 2005/005730, a concentration of material stresses will inevitably take place when loads are exerted thereon, which may lead to fracture or splitting of the fibre.

It is an object of the present invention to provide an improved synthetic fibre for use in an artificial lawn. More specific, it is also an object of the present invention to provide a synthetic fibre with a decreased risk of worn flat due to splitting of the fibre and an improved natural-like look.

SUMMARY

According to a first aspect of the invention, a synthetic fibre of the monofilament type for use in an artificial lawn is provided, in particular for use in an artificial sports lawn, which synthetic fibre has a curved cross section, wherein the synthetic fibre has a centre line arc length (L) to maximum thickness (T) ratio (L/T) of less than 8. More particular, in a further aspect, the centre line arc length (L) to maximum thickness ratio (L/T) is between 4.5 and 3.8, and more preferably between 4.4 and 4.0.

In a further embodiment the synthetic fibre has a convex surface radius (R1) to concave surface radius (R2) ratio (R1/R2) of less than 0.9. More particularly the convex surface radius (R1) to concave surface radius (R2) ratio (R1/R2) is between 0.6 and 0 and even more particular between 0.35 and 0.

In yet a further embodiment the synthetic fibre has a linear mass density between 1000 tex and 2500 tex.

From WO 2005/005730 A1 a synthetic fibre having stiffness-enhancing agents is known. These agents, arranged as protrusion ribs, increase the stiffness of the fibre. The stiffness-enhancing agents are provided at a central axis of the fibre or at both ends of the wings of the fibre. These stiffness-enhancing agents do on the one hand increase the stiffness of the fibre but do on the other hand increase the risk of fracture or splitting of the fibre. This however is a unwanted side-effect of such a design. During play the fibre is exposed to a large load applied thereon. As a result of such a large load the fibre exhibits material stress, which stress is concentrated on weak points of the fibre. These weak points are points where due to a non-smooth surface of the fibre the stress is concentrated. As added ribs on a fibre exhibit a non-smooth transition at the point where the rib shape protrudes, a concentration of stress at this point will directly during use of the field, or inevitably after time, cause the fibre to fracture or split.

Known prior art fibres, such as the fibre known from WO 2005/005730 A1, have a certain thickness to centre line arc length ratio, which ratio, amongst others, determine properties/characteristics of the fibre such as flexibility, resilience and flexural strength. For curved cross section fibres, this thickness is the maximum thickness, and is located at the central portion of the fibre (see reference "T" in FIGS. 1*a-d* for example). The centre line arc length is the length of the centre line (see reference "L" in FIGS. 1*a-d* for example). As the centre line of curved fibres having a certain curvature or radius, the length of this centre line arc is larger than the over all width (W) of the fibre. The ratio of a fibre according to the invention is determined not by the width of the fibre but by the length of the centre arc line.

A synthetic fibre according to a first aspect of the invention, has a L/T ratio of less than 8, preferably between 4.5 and 3.8, and even more preferably between 4.4 and 4.0. According to a further aspect, the fibre has a R1/R2 ratio of less than 0.9, preferably between 0.6 and 0, and even more preferably between 0.35 and 0. According to yet a further aspect, the fibre has a linear mass density between 1000 tex and 2500 tex.

Study showed that such a synthetic fibre according to a first aspect or to the first and more of the above stated aspects of the invention, has improved aesthetics (e.g., appearance) and mechanical properties and closely simulates natural turf. Whereas prior art synthetic fibres show a non optimal stiffness upon a load applied thereon, a synthetic fibre according to an aspect of the invention, having a L/T, R1/R2 ratio within the range of linear mass density as described above, has an increased optimal stiffness upon a load applied thereon. The fibre exhibits increased and more optimal combination of resilience, flexibility, strength and stiffness.

In a further embodiment the curved cross section has a central portion having a maximum thickness and tapered edges having a minimum thickness. The fibre geometry of such a fibre thickness combination provides desirable balance of stiffness and flexibility, as well as of bending resilience of the fibre, preventing a flat orientation in the artificial lawn.

In a further embodiment the cross sectional shape has a circular segment shaped cross section, and in yet another embodiment the synthetic fibre has a convex side which is curved and a side formed by a straight line. A synthetic fibre according to an aspect of the invention can be provided with a convex side and on the other side a line which is anywhere between a straight line and a strong concave line.

A synthetic fibre that is, according to an aspect of the invention, provided with a wave shaped pattern around the circumferential surface has, with respect to prior art fibres such as for example the fibre known from WO 2005/005730, an increased stiffness, because all waves of the pattern do function as stiffness enhancements. A further advantage lies in the smooth transitions of the surface contour having a multiple wave shaped pattern. This wave shaped pattern exhibits an increased stiffness without an increased risk of fracture or splitting of the fibre. All load applied on the fibre during use is divided along the whole surface of the fibre by the multiple waves. Because of this enhanced stress distribution, no stress concentration point exist on the surface of the fibre. It is therefore for a fibre having such a wave shaped pattern less likely to split or fracture. In a further embodiment the wave shaped pattern can also be arranged and extended continuously in the longitudinal direction.

For production of synthetic fibres, the choice of the chemical composition is limited. Several polymers can be used for the production of the fibres. For example polyethylene, polypropylene, polyamide or a combination thereof can be used. When a fibre is produced from such a compositions it has a shiny effect over its surface. This shiny effect gives the fibre a non natural look. As adding certain chemical additives to the composition for reducing this effect, it also changes the intrinsic characteristics of the fibre to unwanted effect. A fibre having a wave shaped patterned surface however does provide a solution to this problem. No change in chemical composition or use of additives is needed. The wave shapes on the fibre surface have a significant light scattering effect, and therefore the fibre has a more "dull" look. The wave patterned surface reflects light in different directions resulting in the light scattering effect. The synthetic fibre can be provided with either a circular segment shaped cross section or a cross section having a convex side and a side formed by a straight line.

Fibre characteristics of an artificial fibre according to an aspect of the invention, having a curved cross section with a maximum thickness central portion and tapered edges with a wave shaped pattern around its circumference can be further optimized by changing the amount of and/or adjusting its size/dimension of the wave shapes. Increasing the amount of wave shapes will increase the light scattering effect, making the fibre more dull, and therefore more natural like. Increase the size/dimension of the wave shapes will lead to an increased stiffness of the fibre, because the waves function as stiffness-enhancing means. Larger waves will exhibit a larger stiffness-enhancing effect.

In a further embodiment the wave shaped pattern is a sine wave shaped pattern. The advantage of a sine wave shaped pattern is that it has an even smoother wave transition in between the antinodes of the pattern. Therefore the fibre can resist an even greater load without losing stiffness and without an increased risk of splitting/fracture.

In another further embodiment the wave shaped pattern is a sickle shaped pattern. When the surface of the fibre is provided with a sickle shaped pattern, more surface of the fibre is embossed, i.e. sunken. Most of the light striking the surface of the fibre, strikes the fibre at embossed locations. These light rays are reflected, however not back towards the light source, they are reflected towards a different position within the embossed sickle shape. The light rays in this way are scattered, resulting in a shadow casting effect giving the fibre a more natural look because of the decreased shininess.

In yet another embodiment the wave shaped pattern on a convex side of the curved synthetic fibre has an equal, number of antinodes as that, on a concave side of the curved synthetic fibre. In addition, the antinodes of the wave shaped pattern on the convex side of the curved synthetic fibre can be positioned opposite to the nodes of the wave shaped pattern on the concave side of the curved synthetic fibre.

In a different embodiment the wave shaped pattern on the convex side of the curved synthetic fibre has a larger number of antinodes than that on the concave side of the curved synthetic fibre.

In another embodiment the number of antinodes on either the convex side or the concave side is at least 4 but not more than 30.

In yet another embodiment at least some waves of the wave pattern have different dimensions.

With changing the dimensions of the wave shapes the characteristics of the fibre can be changed. By combining different sizes, protrusions, dimensions or the like a combination of effects can be achieved. For example large waves can be alternated with small ones combining different effects like stiffness, light scattering effect, fibre resilience, and the like.

In another embodiment of the invention, a synthetic fibre of the monofilament type for use in an artificial lawn is provided, in particular for use in an artificial sports lawn, which synthetic fibre has a curved cross section, wherein the circumferential surface of the synthetic fibre is provided with a wave shaped pattern. In addition, the wave shaped pattern is arranged in the longitudinal direction of the fibre. In a further embodiment the wave shaped pattern is a sine wave shaped pattern or a sickle Jun. 30, 2011 shaped pattern.

The invention also provides in an embodiment an artificial lawn, in particular an artificial sports lawn, comprising a substrate having artificial fibres according to any of the features described above attached thereto.

The above-mentioned and other features and advantages of the invention are illustrated in the following description with reference to the enclosed drawings which are provided by way of illustration only and which are not limitative to the present invention.

DETAILED DESCRIPTION OF THE DRAWINGS

For a better understanding of the invention, like elements will be indicated by the same reference numbers in the description of the figures below.

Figure 1A:
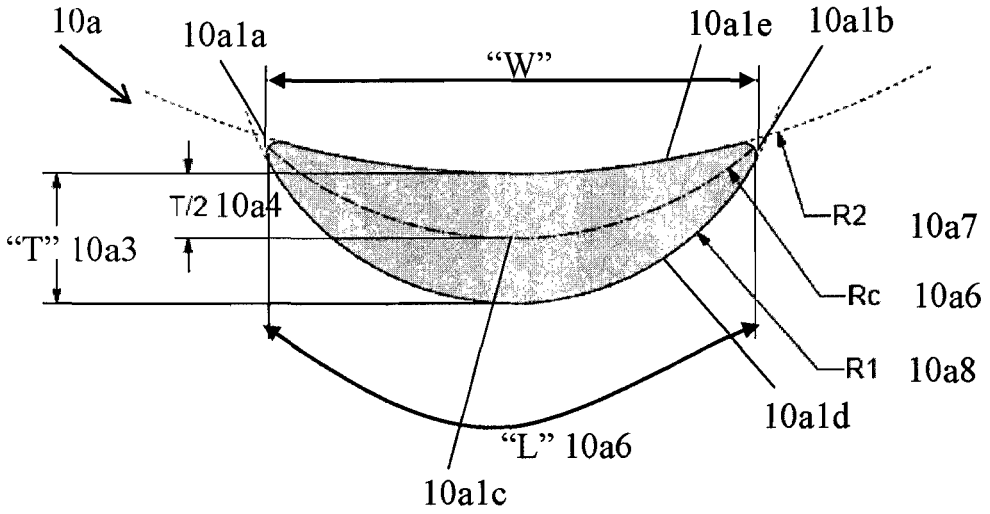
FIG. 1*a*-1*b* show preferred embodiments of a synthetic fibre having a centre line arc length to maximum thickness ratio according to an aspect of the invention.
Figure 1B:
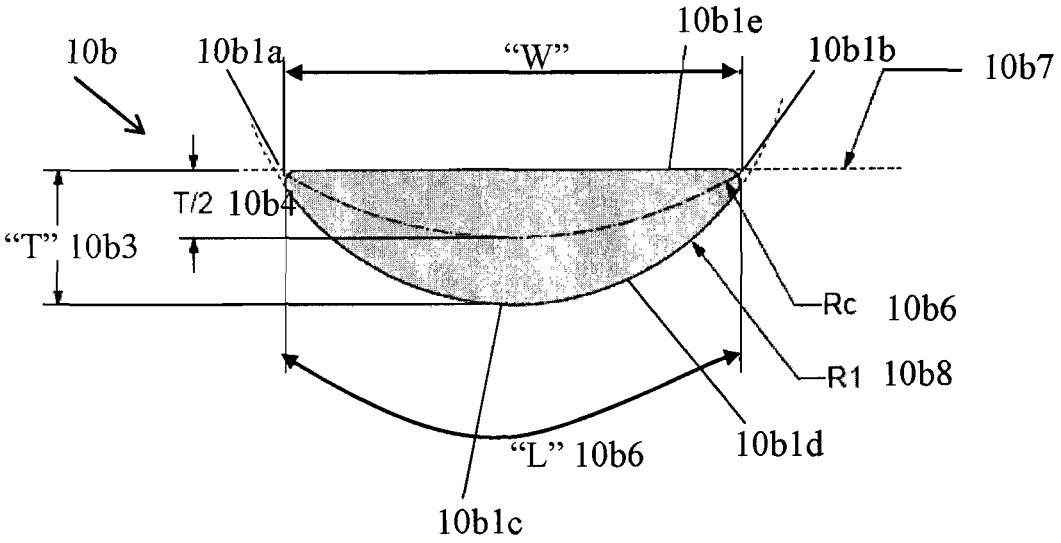

FIG. 1*a* shows in a cross sectional view an embodiment of the invention wherein with reference number 10*a* a synthetic/artificial fibre, for example a synthetic grass sports fibre is illustrated, which is preferably of a monofilament type obtained by an extrusion process.

The bending radius 10*a*6 or amount of curvature of the fibre 10*a* shown in FIG. 1*a* has an effect on the characteristics of the artificial lawn in which it is provided. Increasing the curvature will increase the flexural stiffness of the fibre, which as a result thereto will not unnecessarily assume a flat orientation in the artificial lawn of which the fibre 10*a* forms part. Increasing the stiffness, however, can decrease the playing characteristics of the artificial lawn because when played on, it can lead to an increased risk of injuries and in particular when sliding tackles are made thereon.

Decreasing the stiffness however, will tend the fibre to assume a more flat orientation during play on the artificial lawn. As a result the fibre's functionality as regards to the playing characteristics of the artificial lawn will be lost. "Bare" patches on the field will appear and the risk of injury is increased there.

An optimal stiffness is therefore required to on the one hand prevent a flat orientation and on the other hand still provide a relative soft player friendly artificial lawn with low risk of injuries. An artificial fibre having such characteristics is in an embodiment of the invention disclosed in FIGS. 1*a*-1*d*.

FIG. 1*a* shows that the fibre 10*a* has a curved shape, which curve radius 10*a*6 shown in FIG. 1*a* is only indicative. The invention is not restricted to the curvature shown in FIG. 1*a*, also a more curved fibre or a less curved fibre are considered incorporated in an embodiment of the invention. The ratio between the concave surface radius 10*a*7 (R2) and the convex surface radius 10*a*8 (R1) is in this embodiment less than 0.9, and preferably between 0.6 and 0, and even more preferably between 0.35 and 0. The fibre shown in FIG. 1*b* has a flat surface at its concave side R2.

Besides the stiffness other characteristics of a fibre influence the playability of an artificial grass sports field. In order to provide a natural like artificial grass sports field the fibres used therein, should also have an optimal flexibility and resilience. Flexibility can prevent the fibre from splitting or fracture when undergoing high material stress when being played on. Resilience is needed for the fibre to re-assume an erect orientation after impact of forces applied thereon during play.

The fibre 10*a* shown in FIG. 1*a* is tapered near the edges 10*a*1*a*, 10*a*1*b* and reaches its maximum thickness at the centre portion 10*a*1*c*. The fibre 10*a* shown here has relative thin edges 10*a*1*a*, 10*a*1*b*. Increasing this thickness will increase the stiffness of the fibre. The edges 10*a*1*a* and 10*a*1*b* are preferably round. The fibre 10 according to the invention does therefore not only have non-sharp edges, which have a positive effect on the playing characteristics, it also decreases the risk of injuries when for example making a sliding or tackle.

The centre line arc length 10*a*6 of the fibre 10*a* disclosed in FIG. 1*a* is clearly larger than the thickness T 10*a*3, measured at the middle, central part 10*a*1*c* of the fibre. The centre line arc length 10*a*6 is determined by, and defined as, the length of dotted line Rc 10*a*6 from one end of the fibre 10*a*1*a* to the other 10*a*1*b*. According to the invention the ratio (L/T) between the centre line arc length 10*a*6 and the maximum thickness 10*a*3 is less than 8, preferably between 4.5 and 3.8, and even more preferably between 4.4 and 4.0.

The linear mass density of a fibre according to an aspect of the invention and according to the preferred embodiment disclosed by FIG. 1, is in the range between 1000 tex and 2500 tex. As the centre arc line length to thickness ratio is dependent upon the fibre's tex, the centre arc line length or thickness of a fibre according to an aspect of the invention can be calculated when the tex and one of the centre arc line length and thickness is given.

The above stated characteristics can be changed, and an optimum combination of stiffness, flexibility and resilience can be achieved according to an aspect of the invention wherein the fibre is a fibre 10*a* having a L/T ratio as it is described above, the fibre 10*a* exhibits improved characteristics. Study shows that especially the stiffness of a fibre 10*a* according to this aspects has substantially increased with respect to prior art fibres. The fibre 10*a* characteristics are such that not only a sufficient resilience and flexibility is achieved, but also that it exhibits a flexural stiffness such that it will not unnecessarily assume a flat orientation in the artificial lawn, or the artificial grass sports field in case of a synthetic grass sports fibre of which the fibre 10*a* forms part of.

Such a fibre according to an aspect of the invention and according to FIGS. 1*a*-1*d*, are preferably made of polypropylene, polyethylene, polyamide, a co-polymer, or a blend of one or more of the these polymers. In possible embodiments of the synthetic fibre, the fibre may therefore be made of rubber, which is permanently elastic synthetic polymer, or of a synthetic (co)polymer which will remain within the elastic range upon being subjected to a load.

Figure 1C:
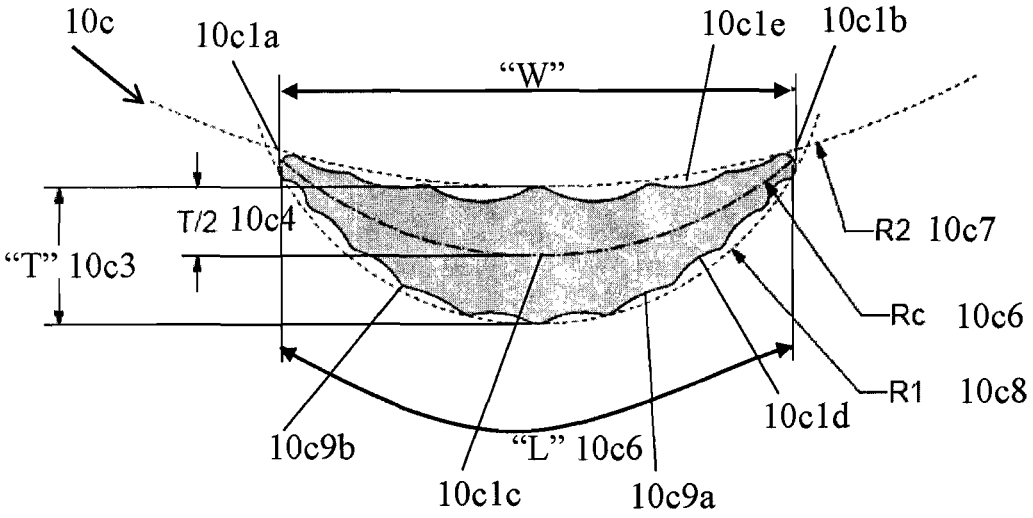
FIG. 1*c*-1*d* show preferred embodiments of a synthetic fibre having a centre line arc length to maximum thickness ratio according to an aspect of the invention and a circumference provided with a wave shaped pattern.
Figure 1D:
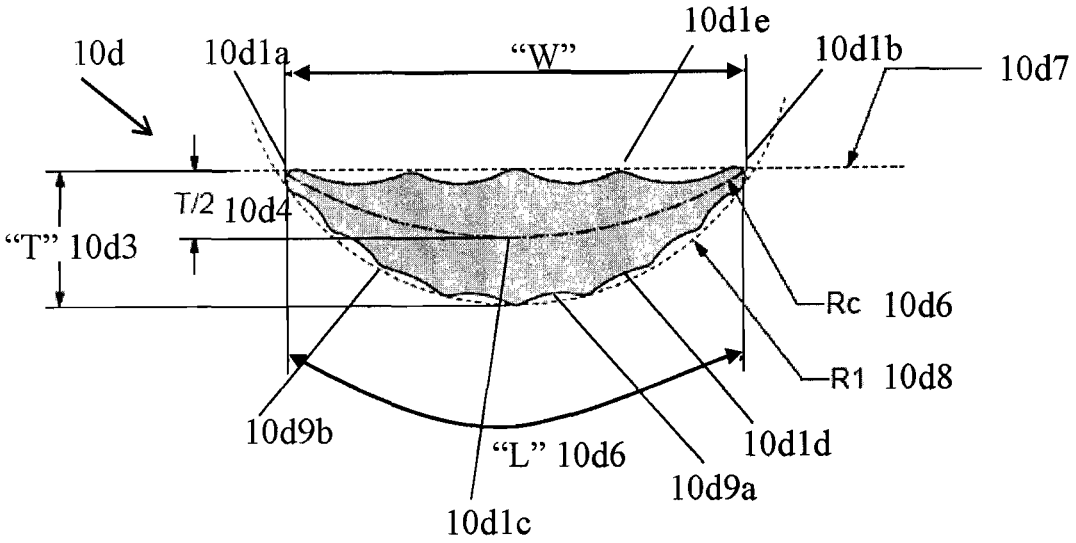

The previously mentioned characteristics can be changed, and an optimum combination thereof can be achieved according to an aspect of the invention wherein the fibre is a fibre 10*c* as shown in FIG. 1*c*, being provided with a wave shaped pattern around the circumferential surface. The wave shaped pattern is provided with nodes 10*c*9*b* and antinodes 10*c*9*a*. The fibre 10*c* shown in FIG. 1*c* has an unequal amount of nodes 10*c*9*b* and antinodes 10*c*9*a* on both sides. The concave side of the fibre 10*c*, which side is above the centre portion 10*c*1*c* of the fibre 10*c*, is in this preferred embodiment provided with seven nodes 10*c*9*b* and six antinodes 10*c*9*a*. The convex side of the fibre 10*c*, which side is below the centre portion 10*c*1*c* of the fibre 10*c*, is in this preferred embodiment provided with eleven nodes 10*c*9*b* and ten antinodes 10*c*9*a*. The nodes 10*c*9*b* of the fibre function as stiffness-enhancing means and the size, amount and position can be changed to influence the stiffness needed for a particular artificial lawn.

The way the fibre 10*c* is provided with a wave shaped surface increases it's natural look. Light rays striking the surface of the fibre 10*c* are directed in a different direction than the direction they originated from. Parallel rays of light striking a fibre 10*c* according to the invention having a wave shaped surface will be directed to different directions. The amount of waves/antinodes and nodes and the size/dimension of the waves influence this light scattering effect. Study showed that a fibre 10*c* according to the invention which is provided with a wave shaped pattern as indicated in FIG. 1*c* has an increased light scattering effect and therefore such a natural look that it closely reassembles real grass.

Figure 2:
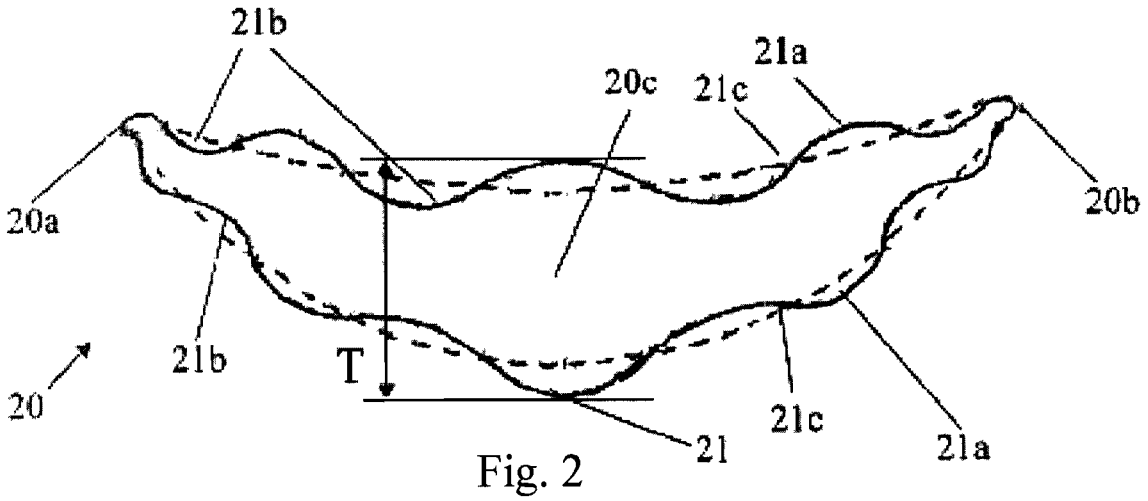
FIG. 2-11 show a synthetic fibre according to other aspects of the invention wherein the fibre has different cross sectional shapes and the fibre is provided with different shapes around the circumferential surface.

In FIG. 2 a different, further embodiment of the invention is shown wherein a fibre 20 is provided with a wave shaped pattern, which is a sine wave shape pattern. Such a pattern has even smoother transitions in-between the positive 21*a* and negative antinodes 21*b*. The nodes 21*c* disclosed in FIG. 2 lack shape edges. The smooth transition between the antinodes (positive 21*a*, and negative 21*b*) prevent the fibre from splitting or fracture, and an increased lifetime is herewith achieved.

The fibre 20 shown in FIG. 2 has relative small and sharp edges 20*a* and 20*b* and an optimal L/T ratio of 3.8. This ratio however is at its maximum 5, preferably it lies between 3 and 4.5 and more preferably between 3.5 and 4 and is as indicated above, optimal at a ratio of 3.8. The concave side of the fibre 20 is provided with eight nodes 21*c* and seven antinodes 21*a*, 21*b*. The other side which in this figure lies below the central portion 20*c* of the fibre 20, being the convex side of the fibre 20, is provided with ten nodes 21*c* and 9 antinodes 21*a*, 21*b*.

Figure 3:
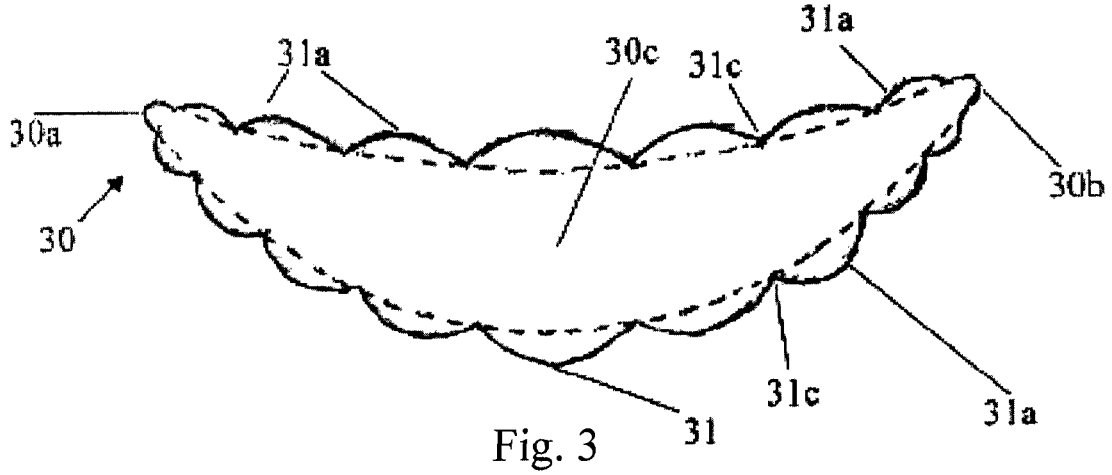

In FIG. 3 a different embodiment of the invention is disclosed wherein a fibre 30 has a curved cross section with a wave shaped pattern around the circumferential. The wave shaped pattern consists of nodes 31*c* and positive antinodes 31*a*. The negative side of a sine shape, being the negative antinode, is absent in this pattern. The advantage of such a pattern is that it has a larger amount of stiffness enhancing means provided around its circumferential, as each positive antinode 31*a* functions as such a stiffness enhancing mean. In this embodiment the fibre 30 has round edges 30*a*, 30*b* which are relatively thin. The L/T ratio of the fibre 30 shown in FIG. 3 is at its optimum at 3.8.

The concave side of an embodiment of the fibre 30 shown in FIG. 3 is provided with seven (positive) antinodes 31*a* and eight nodes 31*c*, and on its convex side the fibre 30 is provided with nine (positive) antinodes 31*a* and ten nodes 31*c*.

Figure 4:
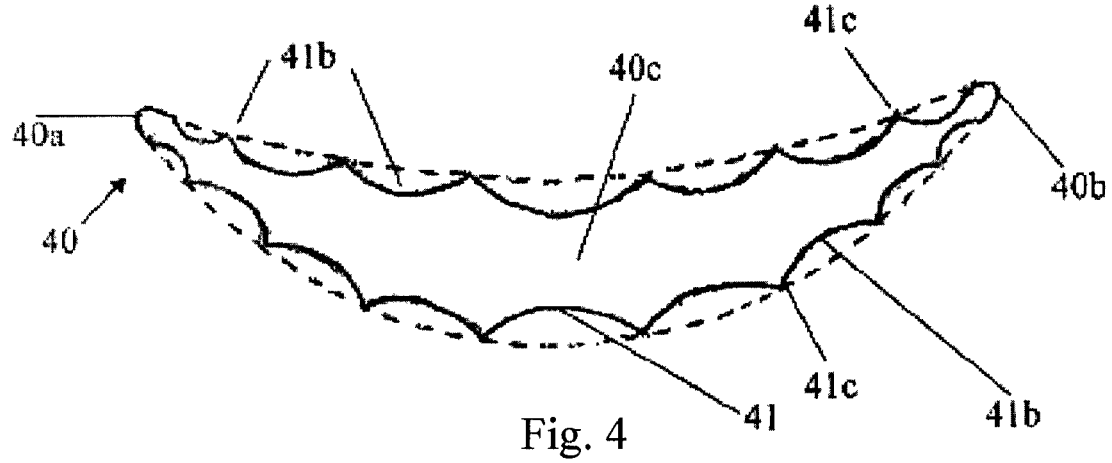

In FIG. 4 yet a different embodiment of the invention is disclosed wherein a fibre 40 has a curved cross section with a wave shaped pattern around the circumferential. The wave shaped pattern consists of nodes 41*c* and negative antinodes 41*b*. Such a wave shaped pattern is likely, because of its shape, to concentrate light rays in the negative antinode 41*b* waves. As a result thereof a shadow casting effect is achieved increasing the natural likeness of the fibre 40 by making the fibre 40 more "dull" looking. The L/T ratio of the fibre 40 shown in FIG. 4 is at its optimum at 5.1. The concave side of an embodiment of the fibre 40 shown in FIG. 4 is provided with seven (negative) antinodes 41*b* and eight nodes 41*c*. On its convex side, the fibre 40 is provided with nine (negative) antinodes 41*b* and ten nodes 41*c*.

Figure 5:
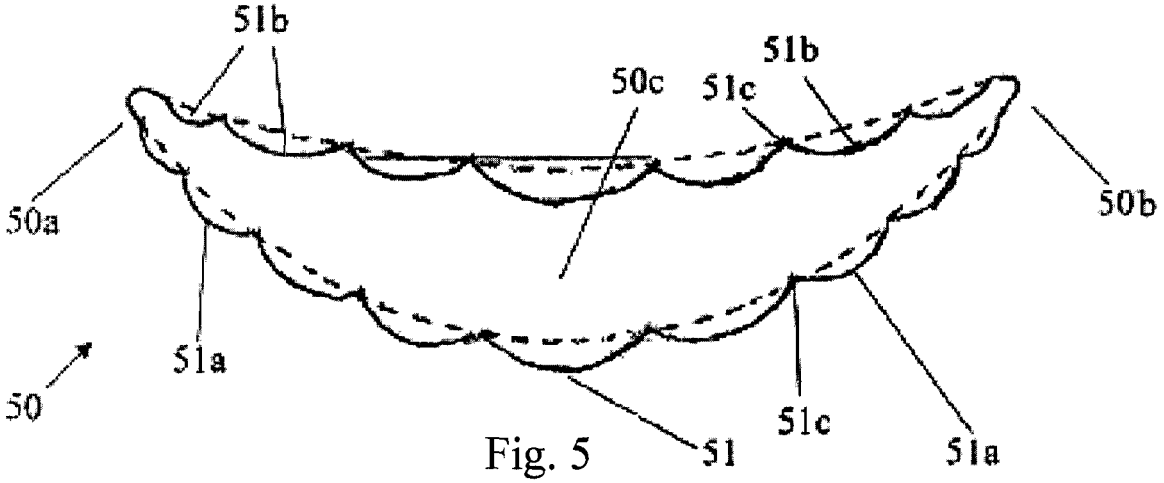

In FIG. 5 yet another embodiment of the invention is disclosed wherein a fibre 50 has a curved cross section with a wave shaped pattern around the circumference. The wave shaped pattern consists of nodes 51*c* and both negative antinodes 51*b* as well as positive antinodes 51*a*. Such a wave shaped pattern will have a shadow casting effect which is different on the concave side of the fibre 50 with respect to the convex side of the fibre 50. The fibres 50 can be provided in bundles in an artificial lawn or artificial grass sports field, and they tend to assume a different orientation with respect to each other. When looking at an artificial lawn or sports field provided with such fibres 50 they seem to have different colors which increases its natural look.

The L/T ratio of the fibre 50 shown in FIG. 5 is at its optimum at 4.3. The concave side of an embodiment of the fibre 50 shown in FIG. 5 is provided with seven (negative) antinodes 51*b* and eight nodes 51*c* and on its convex side the fibre 50 is provided with nine (positive) antinodes 51*a* and ten nodes 51*c*.

Figure 6:
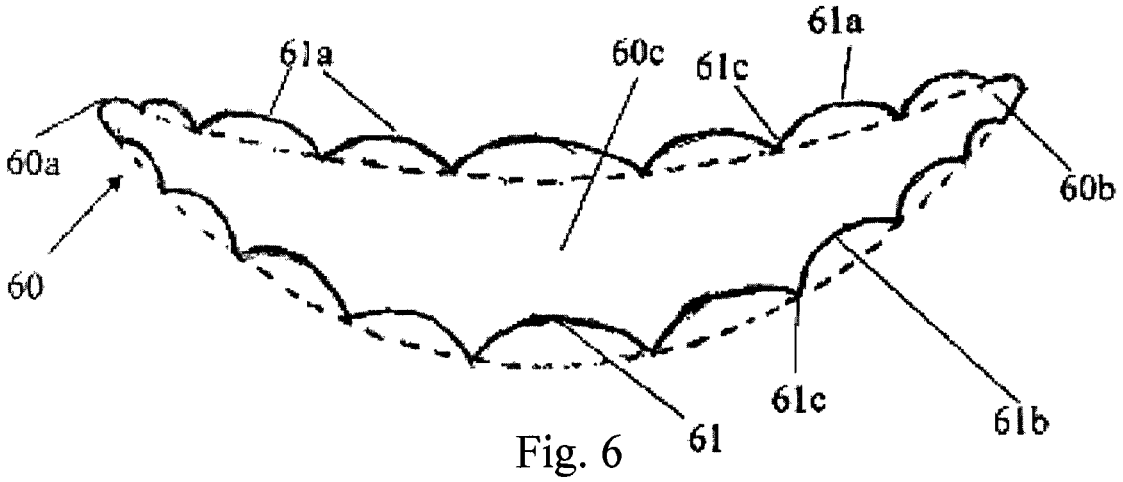

FIG. 6 shows an embodiment of the invention wherein a fibre 60 has a curved cross section with a wave shaped pattern around the circumference. The wave shaped pattern consists of nodes 61*c* and both negative antinodes 61*b* on the convex side as well as positive antinodes 61*a* on its concave side. Such a wave shaped pattern will have a shadow casting effect which is different on the concave side of the fibre 60 as to the convex side of the fibre 60. The fibres 60 tend to assume a different orientation with respect to each other and will therefore seem to have different colors which increases its natural look.

The L/T ratio of the fibre 60 shown in FIG. 6 is at its optimum at 4.3. The concave side of an embodiment of the fibre 60 shown in FIG. 6 is provided with seven (positive) antinodes 61*a* and eight nodes 61*c* and on its convex side, the fibre 60 is provided with nine (negative) antinodes 61*b* and ten nodes 61*c*.

Figure 7:
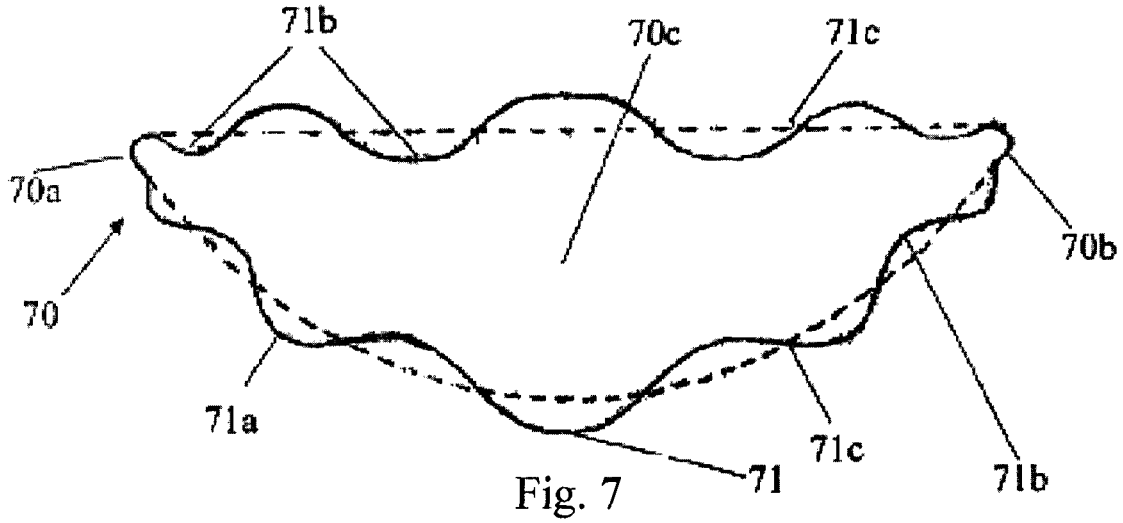

In FIG. 7 a different embodiment of the invention is disclosed wherein a fibre 70 has a curved cross section with a wave shaped pattern around the circumferential, however the fibre is, seen in cross sectional view, flat at one side. The wave shaped pattern, which in this embodiment is a sine shaped pattern, consists of nodes 71*c* and both negative antinodes 71*b* as well as positive antinodes 71*a*. Such a sine shaped pattern will decrease the risk of splitting or fracture due to the smooth transitions at the nodes. The L/T ratio of the fibre 70 shown in FIG. 7 is at its optimum at 2.7. The flat side of an embodiment of the fibre 70 shown in FIG. 7 is provided with seven (both positive and negative) antinodes 71*a*, 71*b* and eight nodes 71*c* and on its convex side, the fibre 70 is provided with nine (both positive and negative) antinodes 71*a*, 71*b* and ten nodes 51*c*.

Figure 8:
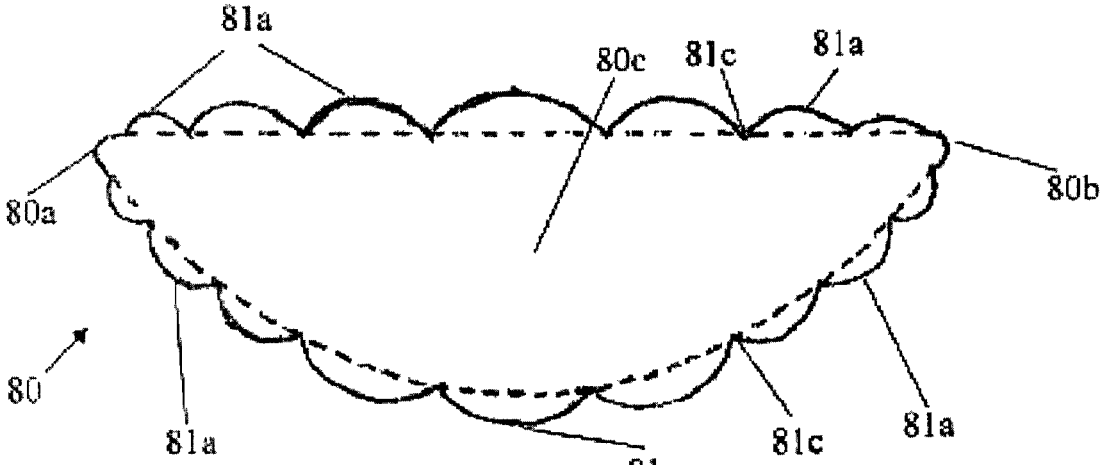

In FIG. 8 an embodiment of the invention is disclosed wherein a fibre 80 has a curved cross section with a wave shaped pattern around the circumferential, however the fibre is, seen in cross sectional view, flat at one side. The wave shaped pattern consists of nodes 81*c* and positive antinodes 81*a*. The L/T ratio of the fibre 80 shown in FIG. 8 is at its optimum at 2.7. The flat side of this embodiment of the fibre 80 is provided with seven (positive) antinodes 81*a* and eight nodes 81*c* and on its convex side, the fibre 80 is provided with nine (positive) antinodes 81*a* and ten nodes 81*c*.

Figure 9:
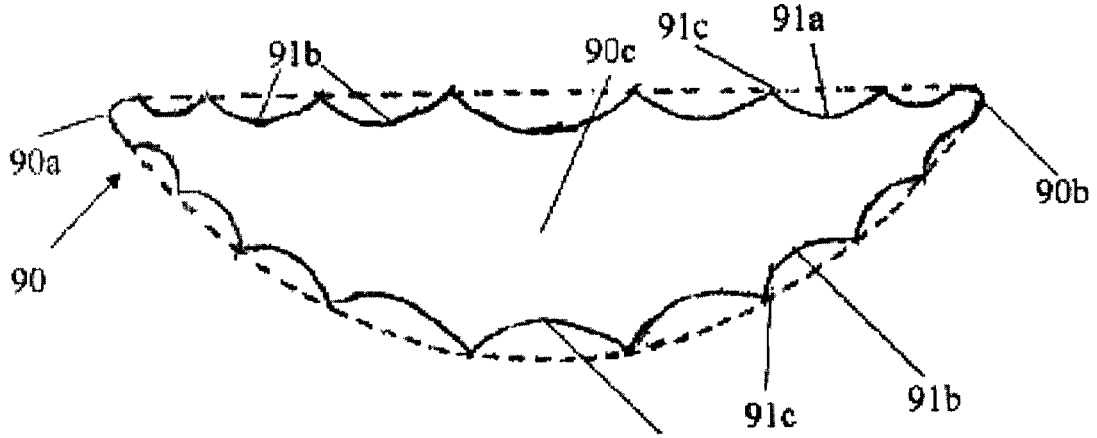

In FIG. 9 another embodiment of the invention is disclosed wherein a fibre 90 has a curved cross section with a wave shaped pattern around the circumference, wherein the fibre is, seen in cross sectional view, flat at one side. The wave shaped pattern consists of nodes 91*c* and negative antinodes 91*b*. The L/T ratio of the fibre 90 shown in FIG. 9 is at its optimum at 2.9. The flat side of this embodiment of the fibre 90 is provided with seven (negative) antinodes

91*b* and eight nodes 91*c* and on its convex side the fibre 90 is provided with nine (negative) antinodes 91*b* and ten nodes 91*c*.

Figure 10:
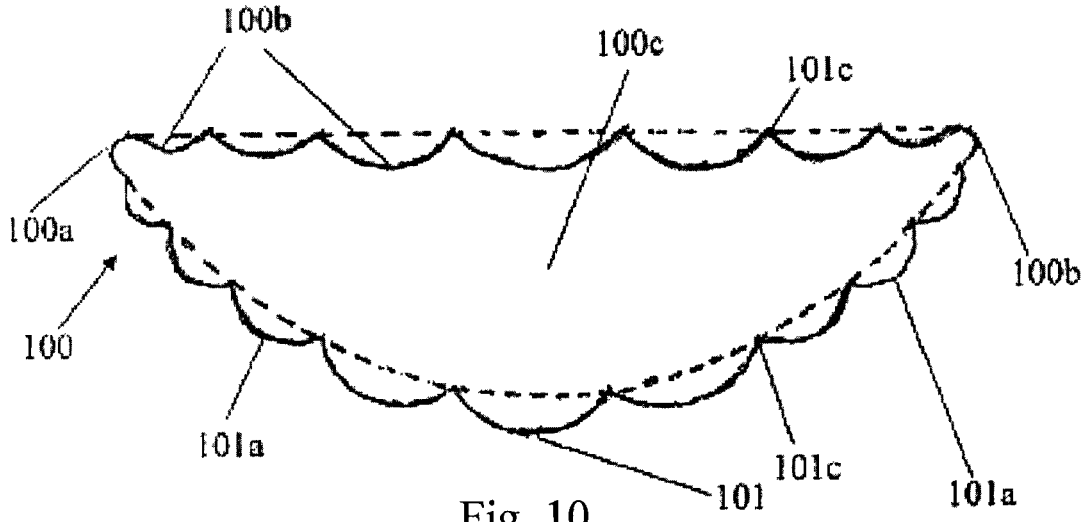

In FIG. 10 yet another embodiment of the invention is disclosed wherein a fibre 100 has a curved cross section with a wave shaped pattern around the circumferential, wherein the fibre is, seen in cross sectional view, flat at one side. The wave shaped pattern consists of nodes 101*c* and both positive and negative antinodes 101*a*, 101*b*. The L/T ratio of the fibre 100 shown in FIG. 10 is at its optimum at 2.9. The flat side of this embodiment of the fibre 100 is provided with seven (negative) antinodes 101*b* and eight nodes 101*c* and on its convex side the fibre 100 is provided with nine (positive) antinodes 101*a* and ten nodes 101*c*.

Figure 11:
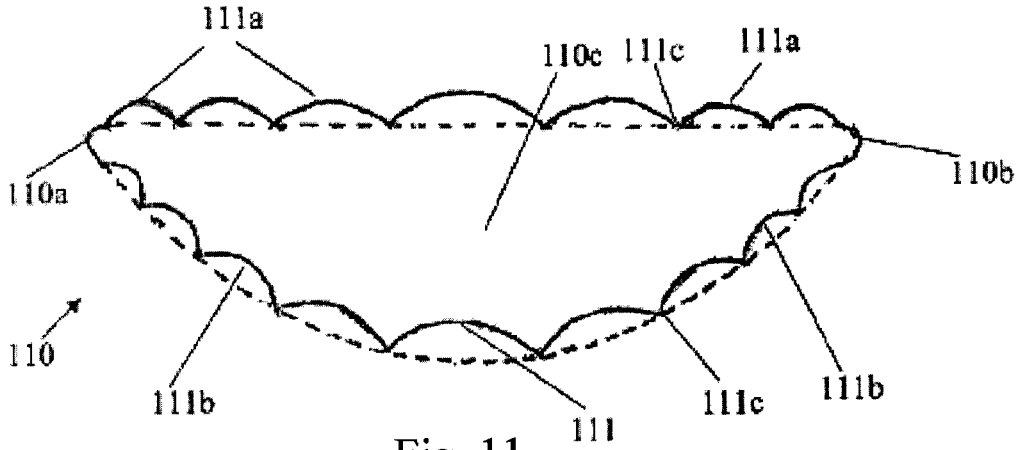

In FIG. 11 yet another embodiment of the invention is disclosed wherein a fibre 110 has a curved cross section with a wave shaped pattern around the circumferential, wherein the fibre is, seen in cross sectional view, flat at one side. The wave shaped pattern consists of nodes 111*c* and both positive and negative antinodes 111*a*, 111*b*. The L/T ratio of the fibre 110 shown in FIG. 11 is at its optimum at 2.9. The flat side of this embodiment of the fibre 110 is provided with seven (positive) antinodes 111*a* and eight nodes 111*c* and on its convex side the fibre 110 is provided with nine (negative) antinodes 111*b* and ten nodes 111*c*.

Figure 12:
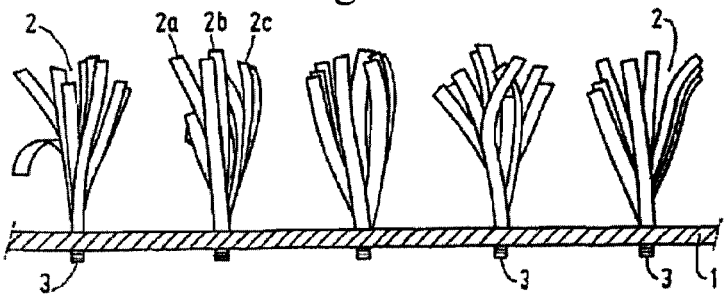
FIGS. 12 and 13 schematically show a few embodiments of an artificial lawn comprising a synthetic fibre according to the invention.
Figure 13:
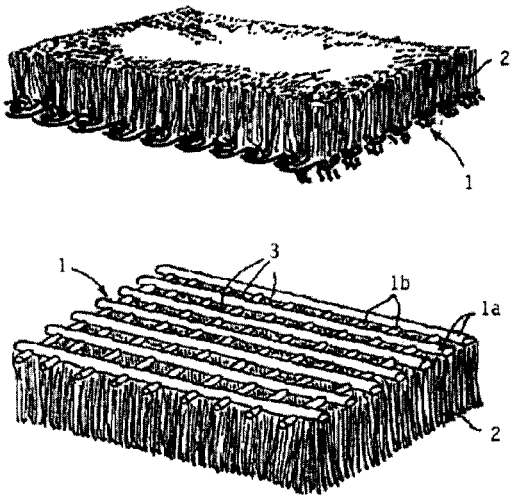

FIGS. 12 and 13 show a few embodiments of an artificial lawn such as an artificial grass sports field in which a synthetic fibre according to the invention can be used. In both figures the artificial lawn comprises a backing 1, to which the several synthetic fibres 2 (corresponding to the fibres 10*a-d*, 20, 30, 40, 50, 60, 70, 80, 90, 100 and 110 shown in FIGS. 1 to 11) are attached at the locations indicated by reference numeral 3, for example by tufting or weaving. The extruded synthetic fibre 2 may be individually attached to the backing 1 or in a bundle of, for example twined, fibres 2*a*-2*c*. The backing member in FIG. 13 has an open structure and is composed of a grid of supporting yarns 1*a*-1*b*, to which the synthetic fibres 2 are attached.

The invention claimed is:

1. A synthetic monofilament fibre for use in an artificial lawn which synthetic fibre has a curved cross section, wherein the synthetic fibre has a centre line arc length to maximum thickness ratio of between 4.5 and 3.8 and a circumferential surface of the synthetic fibre is provided with a sine wave shaped pattern.

2. The synthetic fibre according to claim 1, wherein the synthetic fibre has a centre line arc length to maximum thickness ratio between 4.4 and 4.0.

3. The synthetic fibre according to claim 1, wherein the synthetic fibre has a linear mass density between 1000 tex and 2500 tex.

4. The synthetic fibre according to claim 1, wherein the sine wave shaped pattern extends in the longitudinal direction of the fibre.

5. An artificial lawn comprising a substrate having artificial fibres according to claim 1.

6. A synthetic monofilament fibre for use in an artificial lawn which synthetic fibre has a cross section that falls within a curved outer envelope, wherein a circumferential surface of the synthetic fibre is provided with a wave shaped pattern falling within the curved outer envelope and wherein the synthetic fibre has a centre line arc length to maximum thickness ratio of between 4.5 and 3.8.

* * * * *